US007575223B2

(12) United States Patent
Xia et al.

(10) Patent No.: US 7,575,223 B2
(45) Date of Patent: Aug. 18, 2009

(54) OVERLOAD PREVENTING APPARATUS IN HOIST

(75) Inventors: Desheng Xia, Yamanashi (JP); Koji Koyama, Yamanashi (JP)

(73) Assignee: Kito Corporation, Yamanashi (JP)

( * ) Notice: Subject to any disclaimer, the term of this patent is extended or adjusted under 35 U.S.C. 154(b) by 27 days.

(21) Appl. No.: 11/886,313

(22) PCT Filed: Mar. 2, 2006

(86) PCT No.: PCT/JP2006/303981

§ 371 (c)(1),
(2), (4) Date: Feb. 21, 2008

(87) PCT Pub. No.: WO2006/103866

PCT Pub. Date: Oct. 5, 2006

(65) Prior Publication Data

US 2008/0173851 A1 Jul. 24, 2008

(30) Foreign Application Priority Data

Mar. 29, 2005 (JP) ..... 2005-094069
Mar. 29, 2005 (JP) ..... 2005-094070
Mar. 29, 2005 (JP) ..... 2005-094851

(51) Int. Cl.
*B66D 1/30* (2006.01)

(52) U.S. Cl. ..... 254/372; 254/358; 254/342; 254/347; 254/350

(58) Field of Classification Search ..... 254/372, 254/358, 342, 346, 347, 350
See application file for complete search history.

(56) References Cited

U.S. PATENT DOCUMENTS 4,664,357 A 5/1987 Nishimura (Continued)

FOREIGN PATENT DOCUMENTS

JP 14-8107 6/1939

(Continued)

OTHER PUBLICATIONS

International Search Report for PCT/JP2006/303981 mailed Jun. 20, 2006.

*Primary Examiner*—Emmanuel M Marcelo
(74) *Attorney, Agent, or Firm*—Wenderoth, Lind & Ponack, L.L.P.

(57) ABSTRACT

An overload preventing apparatus of a hoist characterized in including a drive shaft 2 for driving a load sheave 1, a pressure receiving member 4 outwardly fitted to the drive shaft 2, a drive member 10 for transmitting a drive force from operating means 14 to the drive shaft 2 by way of the pressure receiving member 4, a rotation drive member 12 including means of transmitting the drive force from the operating means 14 to the drive member 10 and releasing an engagement with the drive portion 10 when the operating means 14 is applied with a torque equal to or larger than a predetermined torque value and an elastic member 13 mounted along an axial direction of the drive member between a back face of the rotation drive member 12 and an inner side end face of the operating means 14 to pose a problem that a belleville spring is obliged to be used as urging means, and therefore, a stroke in the axial direction of the urging means is small, also a height of an engaging claw becomes small in accordance with the stroke of the belleville spring and a variation in a load relative to a height of the claw becomes large.

15 Claims, 15 Drawing Sheets

U.S. PATENT DOCUMENTS

| | | | | |
|---|---|---|---|---|
| 5,899,441 | A * | 5/1999 | Kuivamaki et al. | 254/366 |
| 6,352,243 | B1 | 3/2002 | Samejima | |
| 6,517,054 | B2 * | 2/2003 | Samejima | 254/352 |

FOREIGN PATENT DOCUMENTS

| | | |
|---|---|---|
| JP | 56-165695 | 12/1981 |
| JP | 60-202093 | 10/1985 |
| JP | 3096290 | 8/2000 |
| JP | 2000-351584 | 12/2000 |

* cited by examiner

OVERLOAD PREVENTING APPARATUS IN HOIST

TECHNICAL FIELD

The present invention relates to an overload preventing apparatus in a hoist of a chain block or the like.

BACKGROUND ART

In a background art, there is known a hoist including a drive shaft for driving a load sheave, a pressure receiving member fixed to the drive shaft, a drive member extractably and retractably screwed to the drive shaft, and a rotation drive member rotatably fitted to the drive member for transmitting driving of a drive wheel of a hand wheel or the like to a press drive member. In such a hoist, there is known an overload preventing apparatus for facilitating adjustment of a restricting load of a hanging load and easily carrying out hoist down even when brought into an overload state including a belleville spring for imparting a bias force to the press drive member and the rotation drive member. (for example, refer to Patent Reference 1)

The overload preventing apparatus described in Patent Reference 1 will be explained as follows in reference to FIG. 14 and FIG. 15.

FIG. 14 is a front view showing a hoist of a background art, FIG. 15 is a disassembled perspective view showing an essential portion of an overload preventing apparatus of the hoist. In FIG. 14, a drive shaft 22 is rotatably inserted to a load sheave 21. The drive shaft 22 is formed with a screw portion 22*a*, the screw portion 22*a* is screwed with a pressure receiving member 24 and a drive member 30 from a side proximate to the load sheave 21, and the pressure receiving member 24 is fixed to the drive shaft 22 by being screwed to an innermost portion of the screw portion 22*a*. The pressure receiving member 24 is concentrically provided with a disk portion 24*a* having a large diameter and a boss portion 24*b* having a small diameter, and the boss portion 24*b* is outwardly fitted with a reverse rotation preventing ring 27 by being interposed by a pair of friction members 29, 29. The reverse rotation preventing ring 27 and the friction members 29, 29 arranged on both sides thereof are constituted to be able to be pressed to a disk portion 24*a* of the pressure receiving member 24 by the drive member 30. The reverse rotation preventing ring 27 includes locking teeth 27*a* inclined to one side in a circumferential direction at an outer periphery thereof, by engaging the locking teeth 27*a* with a ratchet claw 28 axially supported by a side plate, the reverse rotation preventing ring 27 is prevented from being rotated reversely and is made to be rotatable in one direction, that is, a hoist up direction relative to the drive shaft. Further, in FIG. 15, locking teeth 30*c* having the same shape are formed at a circular disk portion constituting a front end face in an axial direction of a flange portion 30*a* of the drive member 30 and on an outer side of a boss portion 30*b* having a large diameter. The boss portion 30*b* having the large diameter of the drive member 30 is outwardly fitted with a rotation drive member 32, and locking teeth 32*a* engageable with the locking teeth 30*c* of the drive member 30 are projected to be formed on a base end side in an axial direction at a base end face in an axial direction of the rotation drive member 32. The respective locking teeth 32*a* of the rotation drive member 32 are formed by a shape substantially adapted to recess grooves formed among the locking teeth 30*c* of the drive member 30. A hand wheel 34 is outwardly fitted to an outer peripheral portion of the rotation drive member 32. Positioning of the rotation drive member 32 relative to the drive member 30 is carried out by screwing a nut 36 to a screw portion of a boss portion 30*d* having a small diameter on a side of the front end of the drive member 30 by way of a rotation restricting member 35 in a circular plate shape and a belleville spring 33 constituting urging means. At an inner peripheral portion of the rotation restricting member 35, a plurality of pieces of engaging projected portions 35*a* substantially in a short shape are projected to be formed on an inner side in a diameter direction. Although the rotation restricting member 35 is restricted from being moved in a peripheral direction relative to the drive member 30, but the rotation restricting member 35 is made to be able to be moved in an axial direction. The belleville spring 33 operates an urge force to press the rotation drive member 32 in a direction of the base end in the axial direction (side of the drive member 30) by way of the rotation restricting member 35.

Next, operation of the hoist of the background art will be explained. First, the nut 36 is screwed, and the belleville spring 33 constituting the urging means presses the rotation restricting member 35 to the side of the base end in the axial direction. The rotation restricting member 35 is brought into contact with the rotation drive member 32, and therefore, the rotation restricting member 35 urges the rotation drive member 32 to the side of the drive member 30. At this occasion, the locking teeth 30*c* of the drive member 30 and the locking teeth 32*a* of the rotation drive member 32 are engaged with each other. In a case of hanging down a load equal to or smaller than the restricting load from a load chain wound around the load sheave 21, when the rotation drive member 32 is rotated by operating the hand wheel 34, rotation is transmitted to the drive member 30 by way of the locking teeth 32*a*, 30*c*, and the load can be hoisted up by pressing to rotate the pressure receive member 23 by the drive member 30. In contrast thereto, in a case of hanging up an overloaded load, when the rotation drive member 32 is rotated by the hand wheel 34, while pressing back the rotation drive member 32 to the side of the front end in the axial direction against the urge force of the belleville spring 33 along with the hand wheel 34, press faces of the locking teeth 32*a* in hoist up are pressed up along press faces of the locking teeth 30*c* of the drive member 30 in hoist up, the locking teeth 32*a* of the rotation drive member 32 ride over the locking teeth 30*c* of the drive member 30, and are contained to next grooves among the locking teeth 30*c* of the drive member 30 to be engaged therewith by the urge force of the belleville spring 33. In this way, when the hand wheel 34 is rotated in the hoist up direction under the overload state, although the drive member 30 is not rotated, only the rotation drive member 32 is rotated, the drive member 30 cannot be rotated regularly, and the overload is prevented from being hoisted up (wound up).

Patent Reference 1: Japanese Patent Specification No. 3096290 (refer to pages 3 through 5, FIGS. 1, 2)

DISCLOSURE OF INVENTION

However, according to the overload preventing apparatus of the hoist of the background art, there is constituted a structure in which the urging means and the nut for pressing the urging means are laminated on the drive member, and therefore, in order to downsize the hoist, as urging means, urging means having a small stroke of a belleville spring or the like is obliged to be used, and therefore, the stroke in the axial direction of the urging means is reduced, also a height of the overload preventing locking teeth is reduced in conformity with the stroke of the belleville spring, and therefore, in order to provide an accuracy to the height of the locking teeth, machining or the like is needed which brings about an increase in cost. Further, since the height of the overload preventing locking teeth is low, and therefore, when a fabrication tolerance is made to stay the same, in comparison with the locking teeth having a high height, a rate of an error of the fabrication tolerance relative to the height of the teeth is increased, and therefore, a variation in a slip load is increased, and stability of quality of product is deteriorated. Further, although it is necessary to make the slip load fall in a range of a certain value in delivery of the hoist, since the stroke is small, as an influence of an error of the spring pressure by an accumulated dimension error of related parts is liable to have a significant effect, the spring pressures of all the products need to be adjusted in delivery. Also, since an adjusting range is very small, the adjustment is difficult and skill is required. Further, as shown by FIG. 14, the hand wheel is guided by slightly being brought into contact with a flange portion of the drive member, and therefore, when a hand chain is operated to be pulled by the hand, the hand wheel is liable to be inclined and is influenced by the belleville spring, and therefore, poses a problem that a friction is brought about in a sliding face in the axial direction.

Further, when the height of the overload preventing locking teeth is constituted by a constant height, a high stroke spring is needed. In that case, it is necessary to laminate a number of layers of the belleville spring. As a result, there poses a problem that the hoist is large-sized.

Further, as an overload preventing apparatus of a hoist for resolving the above-described problems by using an elastic member having a large stroke without making a hoist apparatus large-sized, the applicant has developed an overload preventing apparatus including a drive shaft for driving a load sheave, a pressure receiving member outwardly fitted to the drive shaft, a drive member for transmitting a drive force from a hand wheel to the drive shaft by way of the pressure receiving member, a rotation drive member having means for transmitting a drive force from the hand wheel to the drive member and releasing an engagement with the drive member when the hand wheel is applied with a torque equal to or larger than a predetermined torque value, and a plurality of elastic members mounted along an axial direction of the drive member between a back face of the rotation drive member and an inner side end face of the hand wheel for urging the rotation drive member.

However, according to the overload preventing apparatus, the rotation drive member is urged by a plurality of springs arranged along the axial direction of the drive member, and therefore, a spring pressure received by the rotation drive member becomes nonuniform, and therefore, there poses a problem that in overloading, the rotation drive member is liable to be inclined, the rotation drive member interferes with a guide portion at an inner periphery of the hand wheel by being inclined and the drive member cannot smoothly be moved in the axial direction. Further, the inner side end face of the hand wheel is directly pressed to the spring, and therefore, a friction resistance by the spring is brought about between the hand wheel and a sliding face of a washer for locking the hand wheel and the drive member, an accuracy of the washer is not necessarily constant, and therefore, there poses a problem that the slip load between the rotation drive member and the drive member in overloading does not become constant.

The invention resolves the above-described problem and is characterized in an overload preventing apparatus of a hoist including a drive member for driving cooperatively with driving of operating means, and a drive apparatus for transmitting driving of the drive member to a drive shaft for driving the operating means by way of brake means, wherein a space having a length substantially the same as a width of the operating means is provided between an inner peripheral face of the operating means and an outer periphery of the drive member, the space is inwardly provided with the drive member, a rotation drive member engaged with the operating means and having means for transmitting driving of the operating means to the drive member and restricting a torque transmitted to the drive member by a torque of the operating means, a spring member wound around an outer periphery of the drive member for pressing the rotation drive member to a side of the drive member, and a spring holder engagingly attached to the drive member for pressing an end portion of the spring member, and the spring member is arranged in a cylindrical space formed among an inner peripheral face of the operating means and the outer peripheral face of the drive member, and a back face of the rotation drive member and the spring holder and extended in the axial direction.

Further, the invention is characterized in that the operating means is a hand wheel having a ring-like guide portion at an end face of an inner periphery thereof, and the outer peripheral face of the drive member and an outer peripheral face of the spring holder are brought into sliding contact with the ring-like guide portion.

Further, the invention is characterized in that the drive member includes a step portion for restricting the spring holder from moving to a side of the rotation drive member, and the spring holder is screwed to the drive member to be brought into contact to be fixed by the step portion.

Further, the invention is characterized in that the spring member is a coil spring wound around the outer periphery of the drive member and expanded between the rotation drive member and the spring holder.

Further, the invention is characterized in that the coil spring comprises a large diameter coil spring and a small diameter coil spring laminated at an inner periphery of the large diameter coil spring.

Further, the invention is characterized in that the spring holder is brought into contact with a locking step portion provided at the drive member to be screwed to be fastened to the drive member in being rotated in a direction the same as a direction of idly rotating the rotation drive member. Further, the invention is characterized in that the spring holder is provided with an outer diameter larger than an inner diameter of the operating means and brought into sliding contact with the ring-like guide portion provided at the end face of the inner periphery of the hand wheel to guide the hand wheel.

Further, the invention is characterized in that the operating means is provided by providing a predetermined gap between the drive member and the spring holder.

DESCRIPTION OF REFERENCE NUMERALS AND SIGNS

Figure 1:
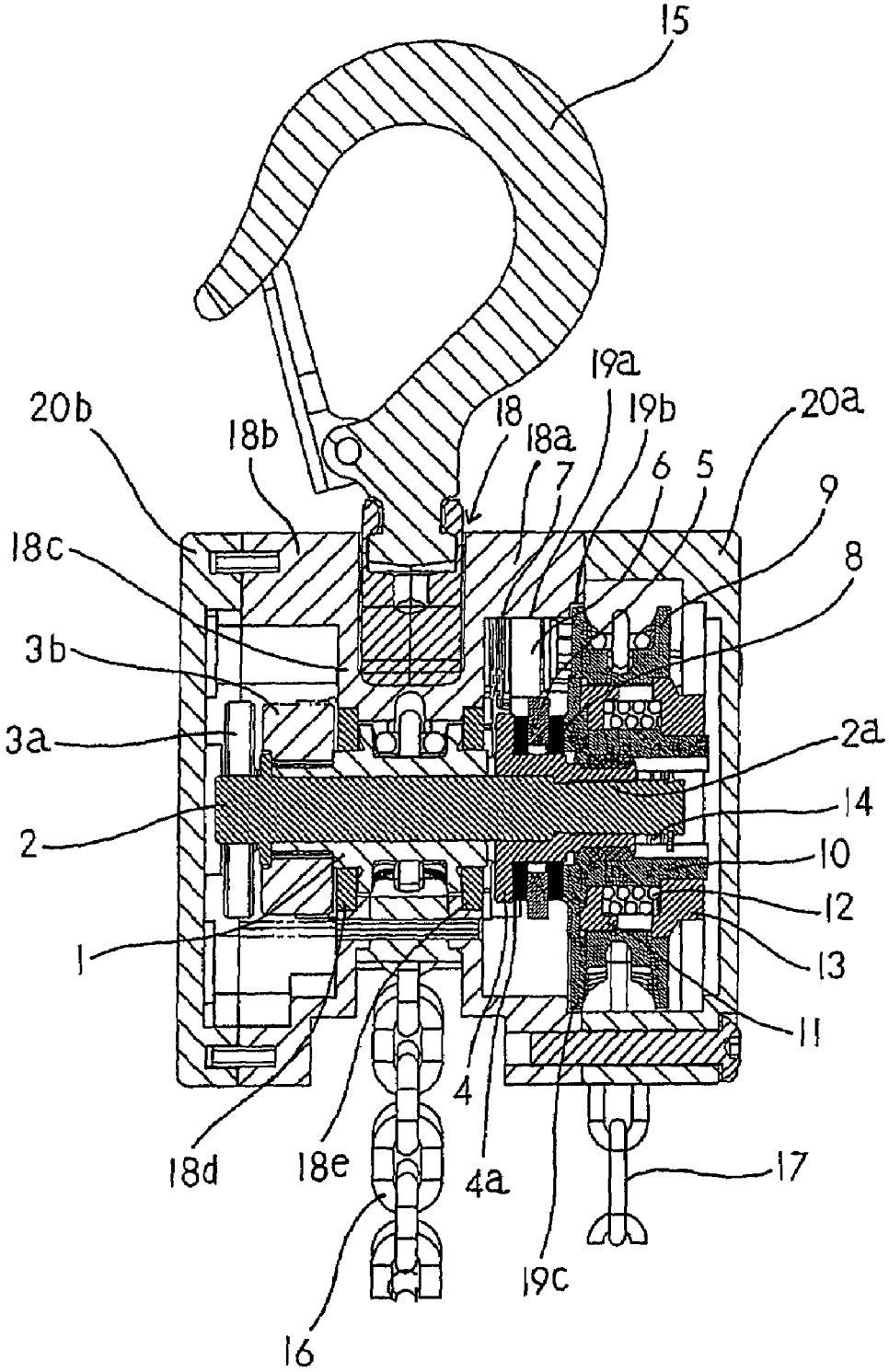
FIG. 1 is a front view of a hoist of the invention.

1 load sheave
2 drive shaft
2*a* fitting portion
2*b* idly rotating portion
2*c* engaging portion
2*d* screw portion
3*a* speed reducing gear
3*b* load gear
4 pressure receiving member
4*a* boss portion
5 reverse rotation preventing wheel
6 claw
7 spring
8 brake plate
9 hand wheel
9*a* fitting recess portion
9*b* insertion groove
9*c* inner side inner periphery
9*d* inner periphery end face
9*e* ring-like guide portion
9*f* space
10 drive member
10*a* female screw
10*b* flange
10*c* boss portion
10*d* engaging teeth
10*e* screw groove
10*f* locking step portion
10*g* guide portion
10*h* opening portion
10*i* end portion
10*j* locking teeth portion
10*k* inclined teeth portion
11 rotation drive member
11*a* engaging teeth
11*b* fitting projected portion
11*c* locking teeth portion
11*d* inclined teeth portion
11*e* link portion
12 spring
12*a* inner spring
12*b* outer spring
12*c* fitting projected portion
13 spring holder
13*a* screw portion
13*b* contact portion
13*c* guide portion
14 rotation restricting member
15 upper hook
16 load chain
17 hand chain
18 frame main body
18*a* drive side frame
18*b* speed reducing side frame
18*c* connecting frame
18*d*, 18*e* bearing plates
19*a* opening portion
19*b* ring-like groove
19*c* space
20*a* drive side cover
20*b* speed reducing machine side cover

BEST MODE FOR CARRYING OUT THE INVENTION

An embodiment of the invention will be explained as follows.

Figure 2:
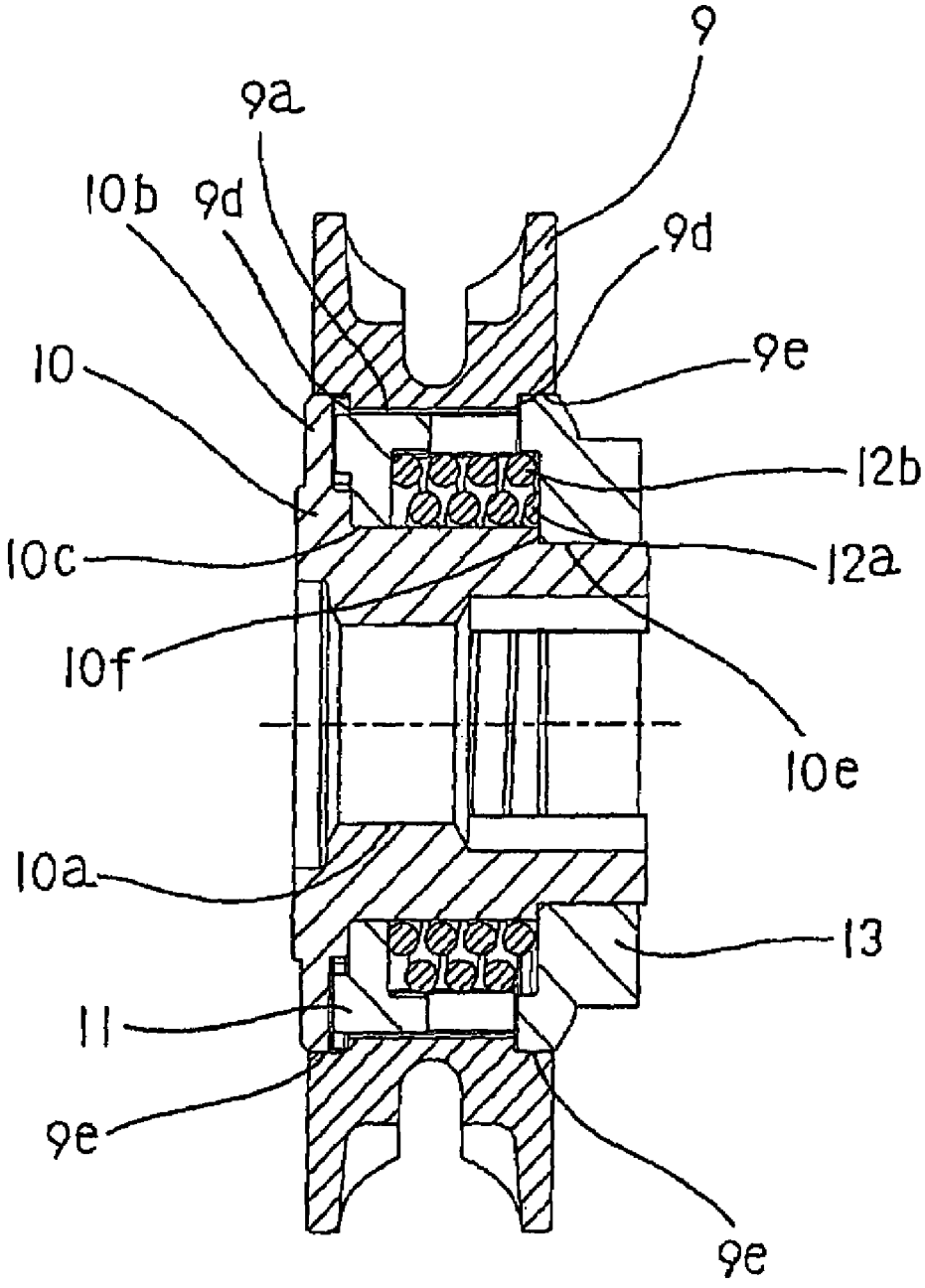
FIG. 2 is a view enlarging an essential portion of the overload preventing apparatus of FIG. 1.
Figure 3:
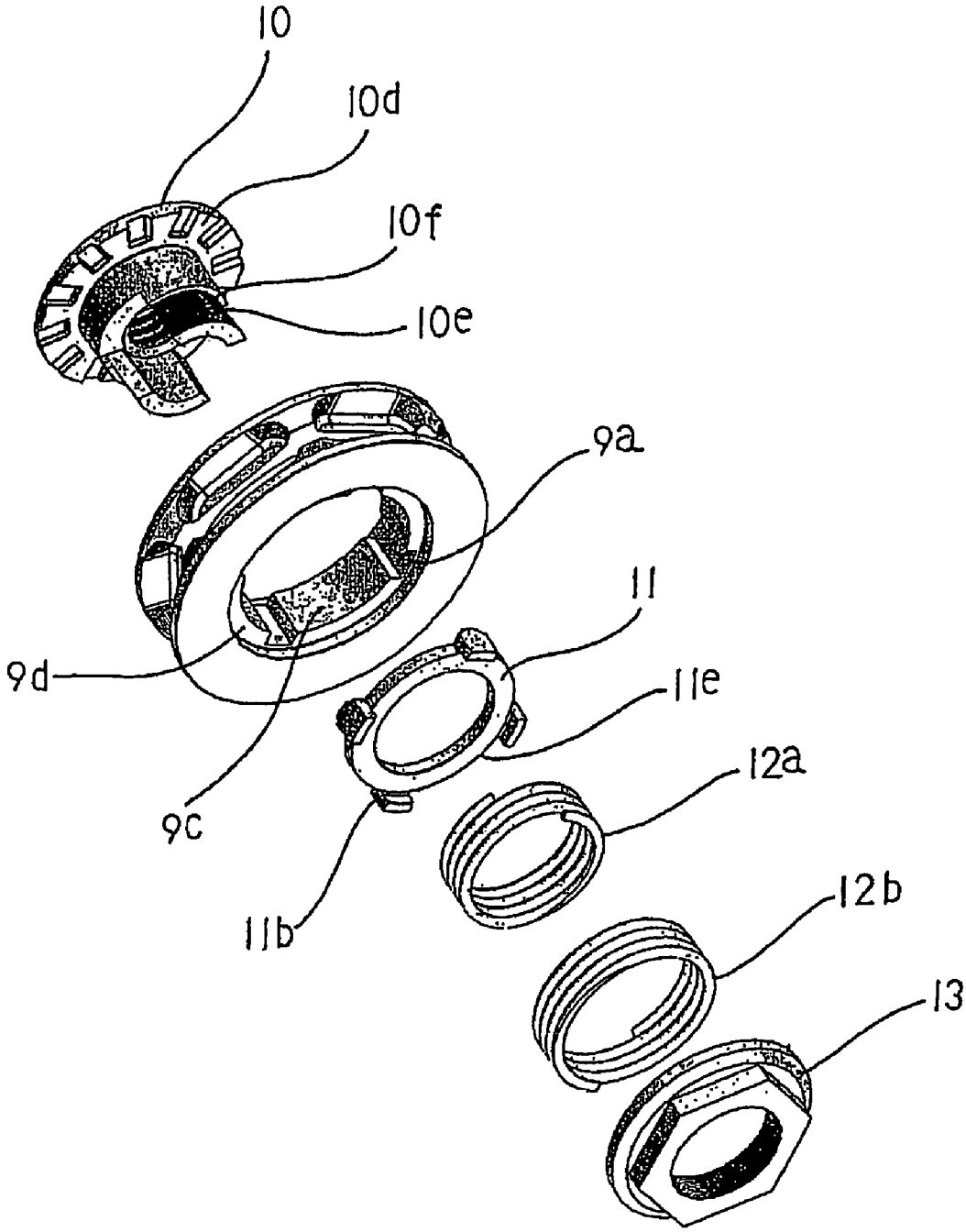
FIG. 3 is a disassembled perspective view of FIG. 2.
Figure 4:
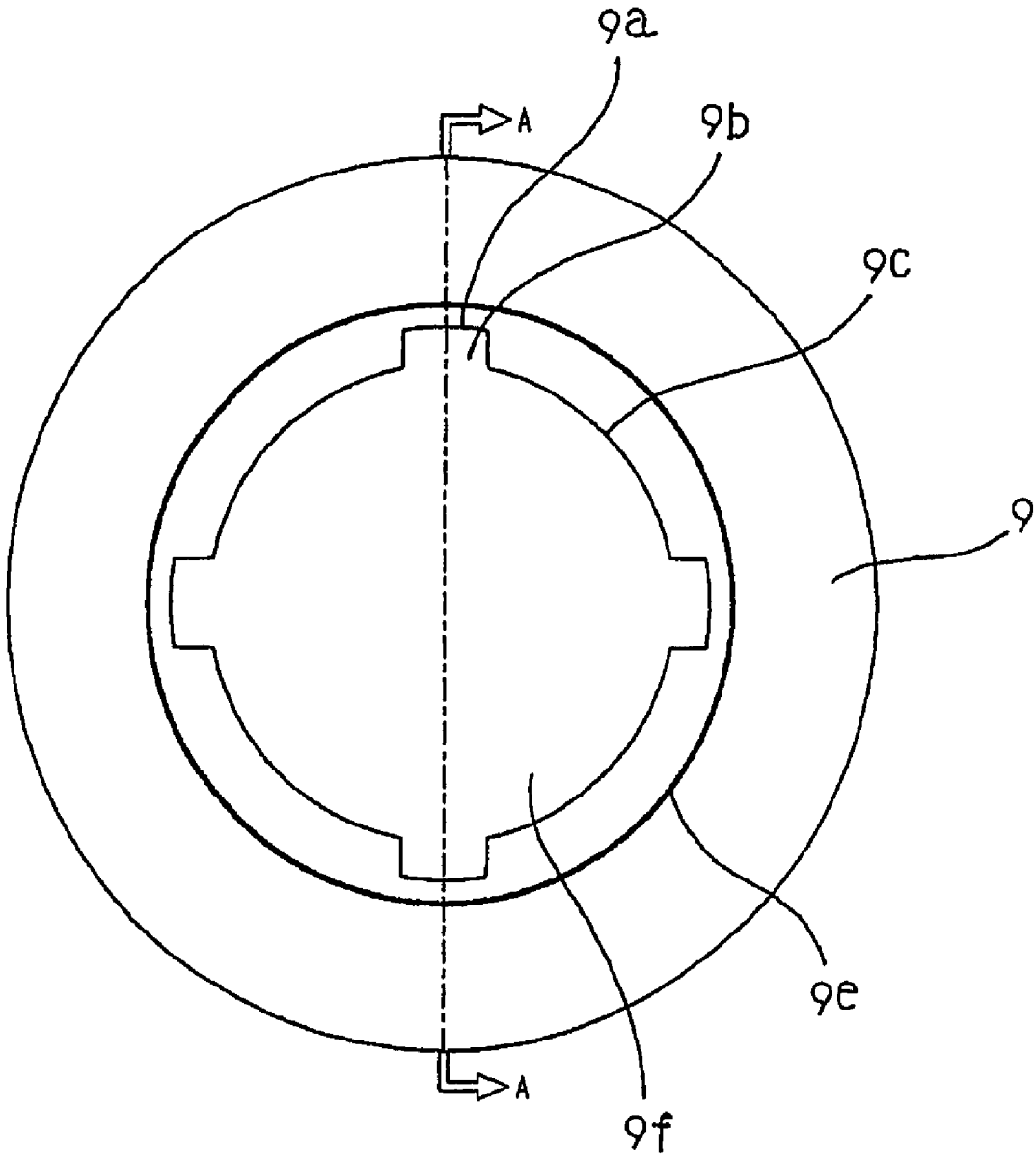
FIG. 4 is a front view of a hand wheel of FIG. 2.
Figure 5:
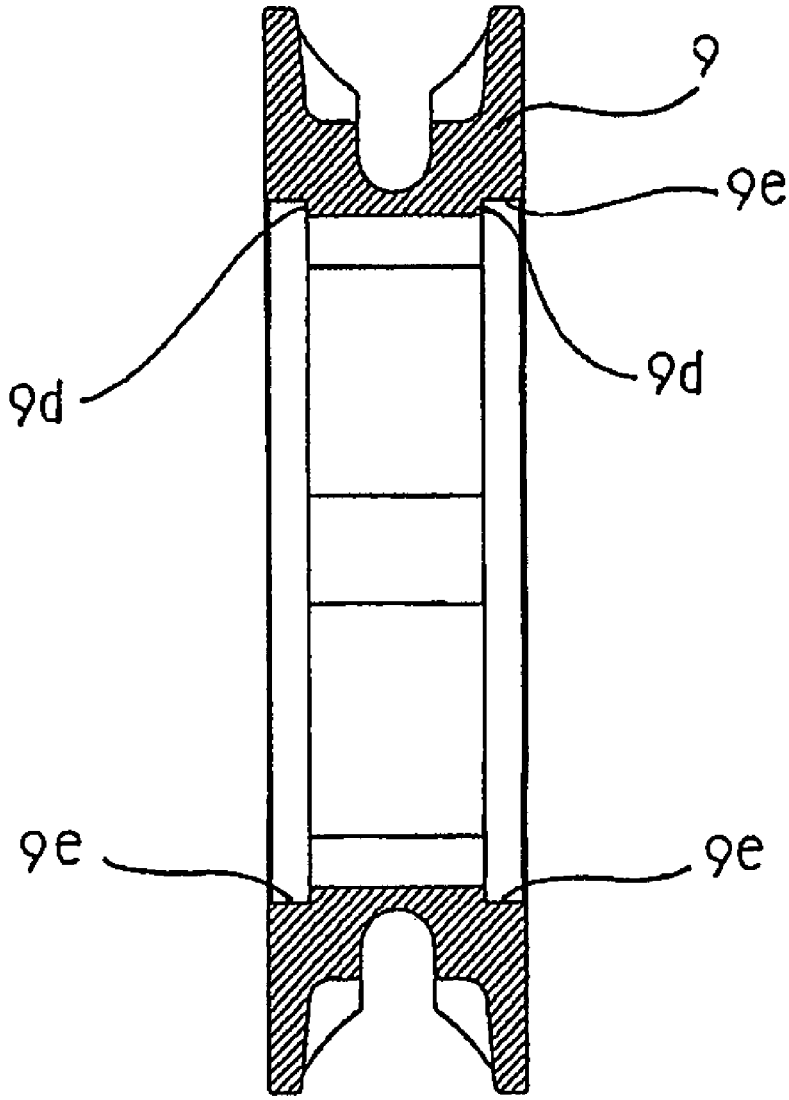
FIG. 5 is a sectional view taken along a line A-A of FIG. 4.
Figure 6:
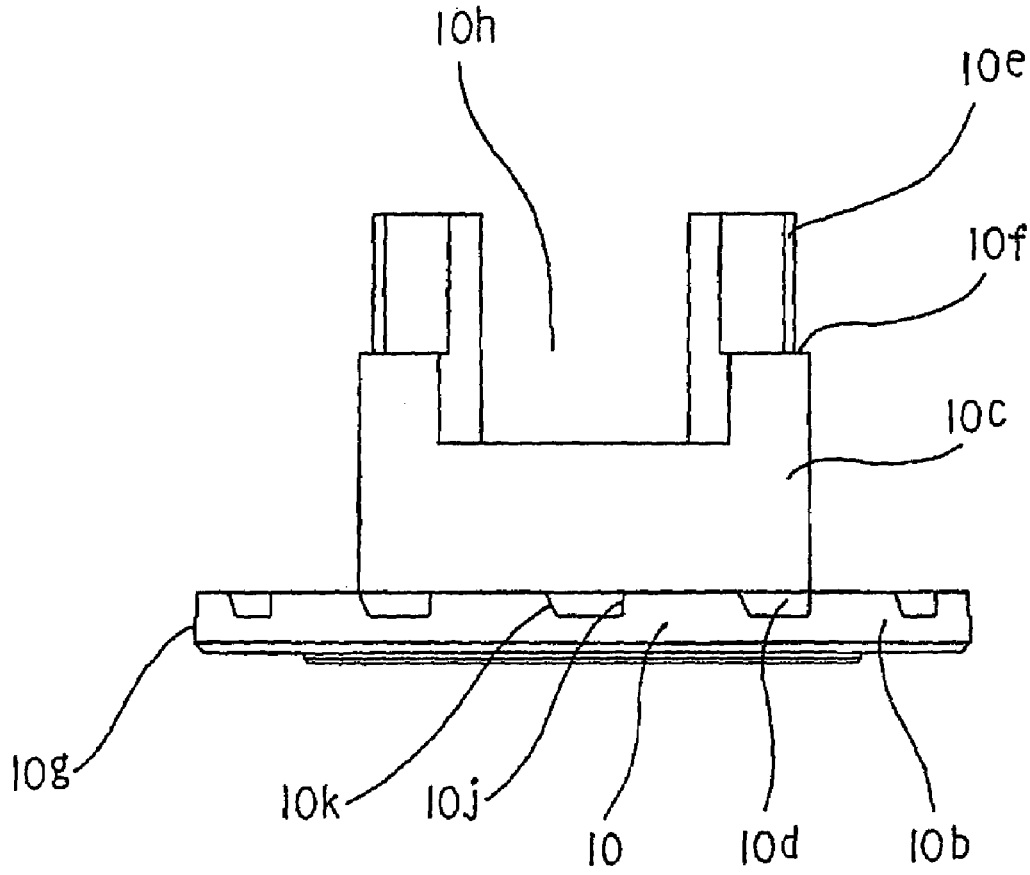
FIG. 6 is a front view of a drive member of FIG. 2.
Figure 7:
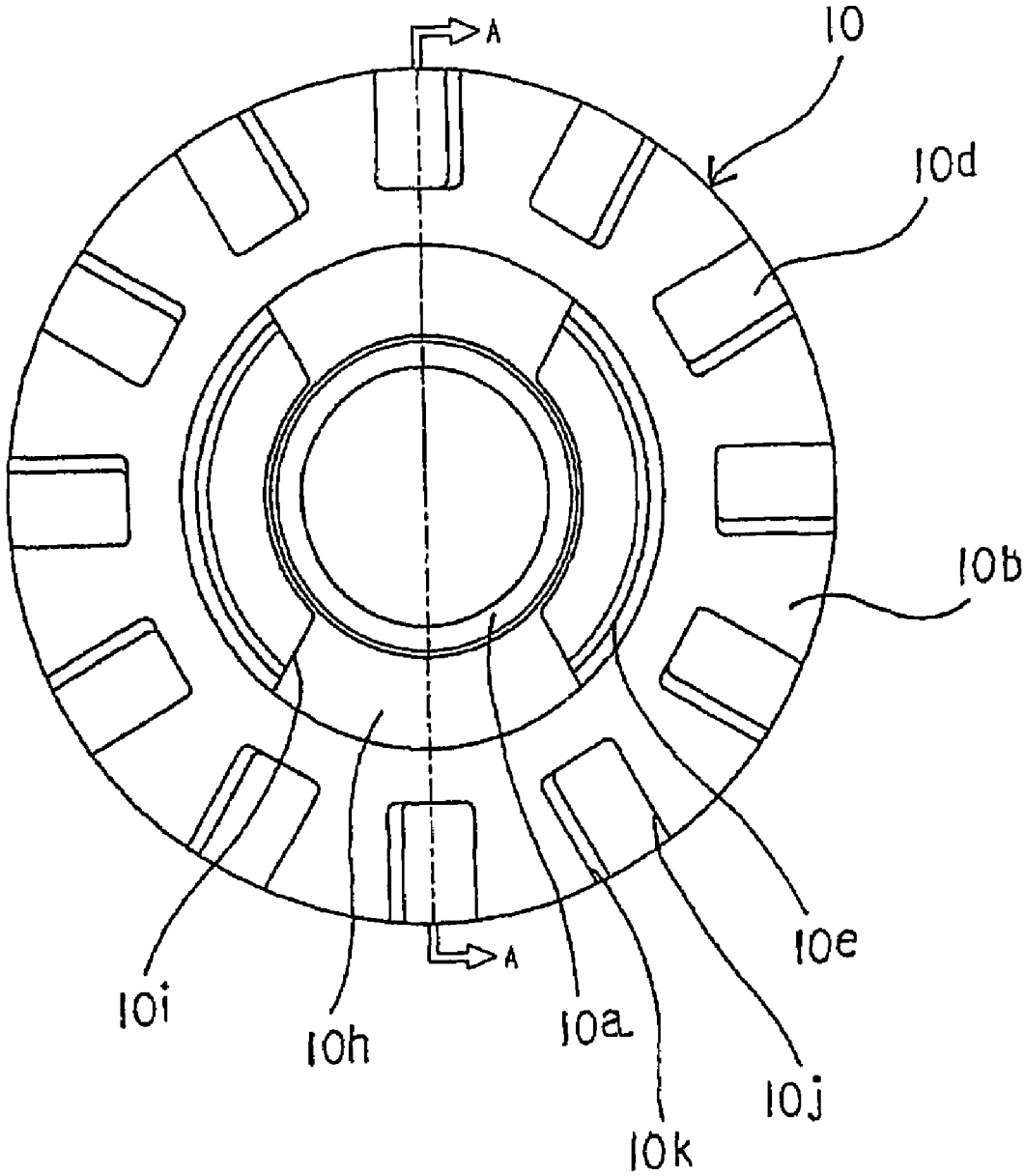
FIG. 7 is a front view of FIG. 6.
Figure 8:
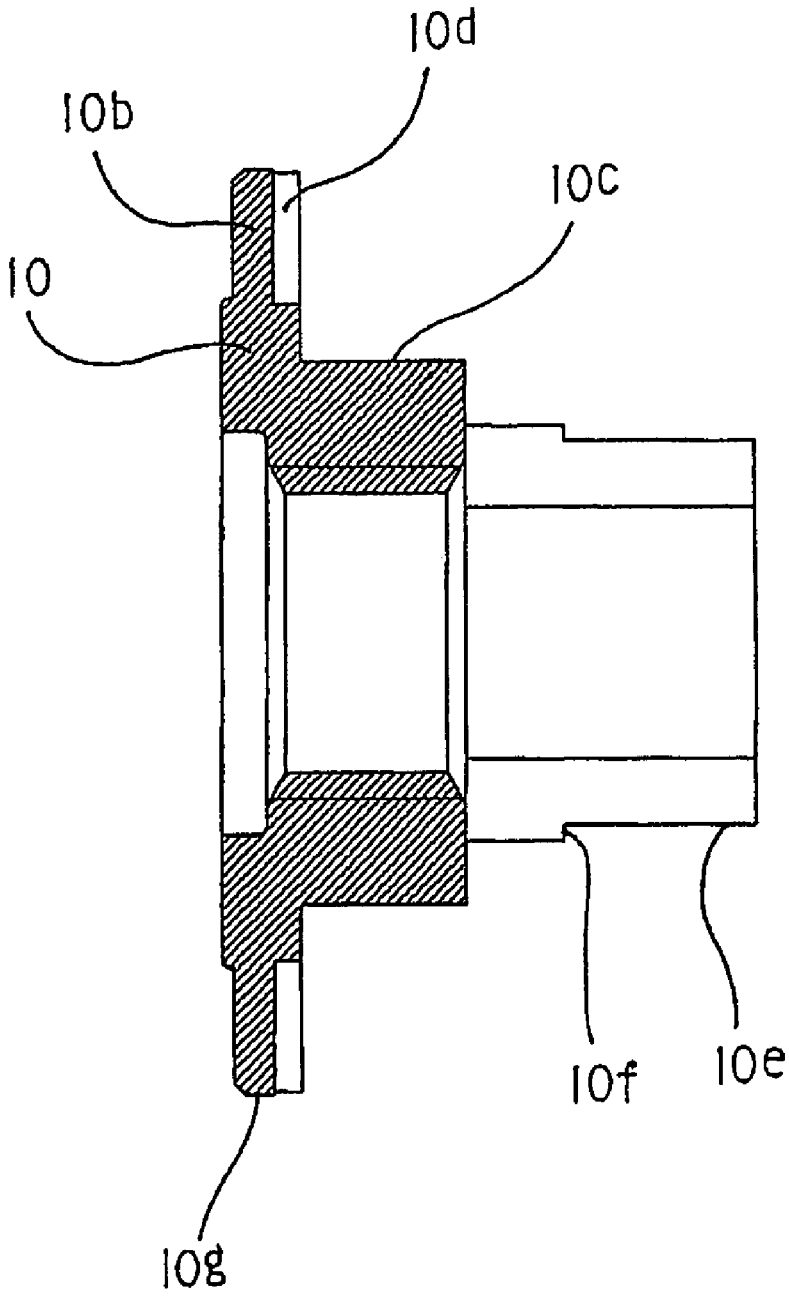
FIG. 8 is a sectional view taken along a line A-A of FIG. 7.
Figure 9:
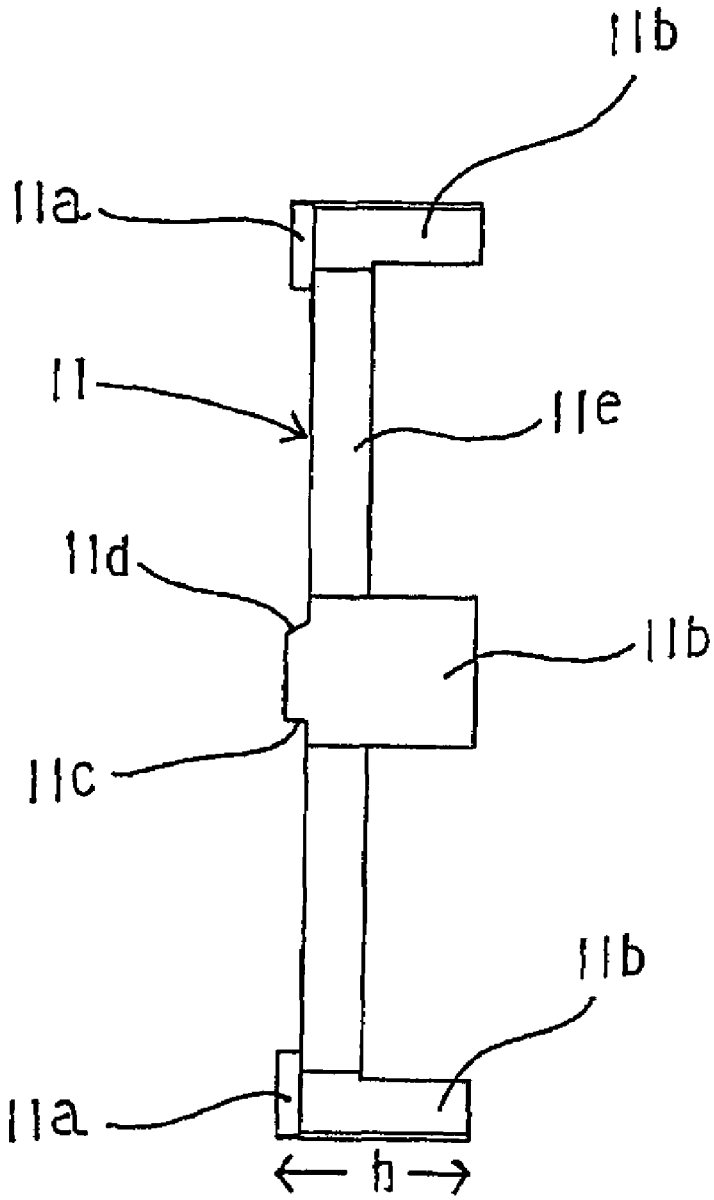
FIG. 9 is a front view of a rotation drive member of FIG. 2.
Figure 10:
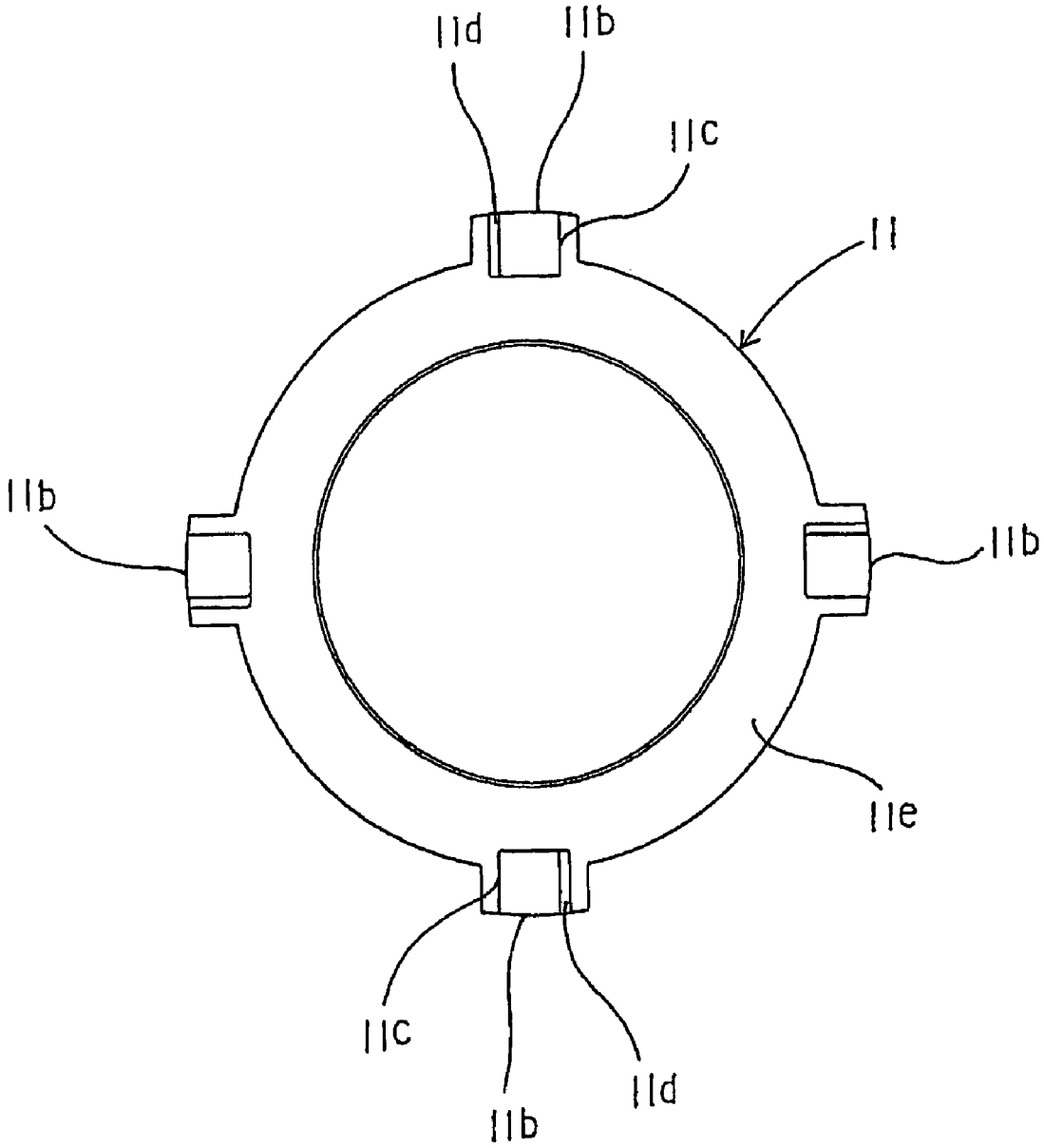
FIG. 10 is a bottom view of FIG. 9.
Figure 11:
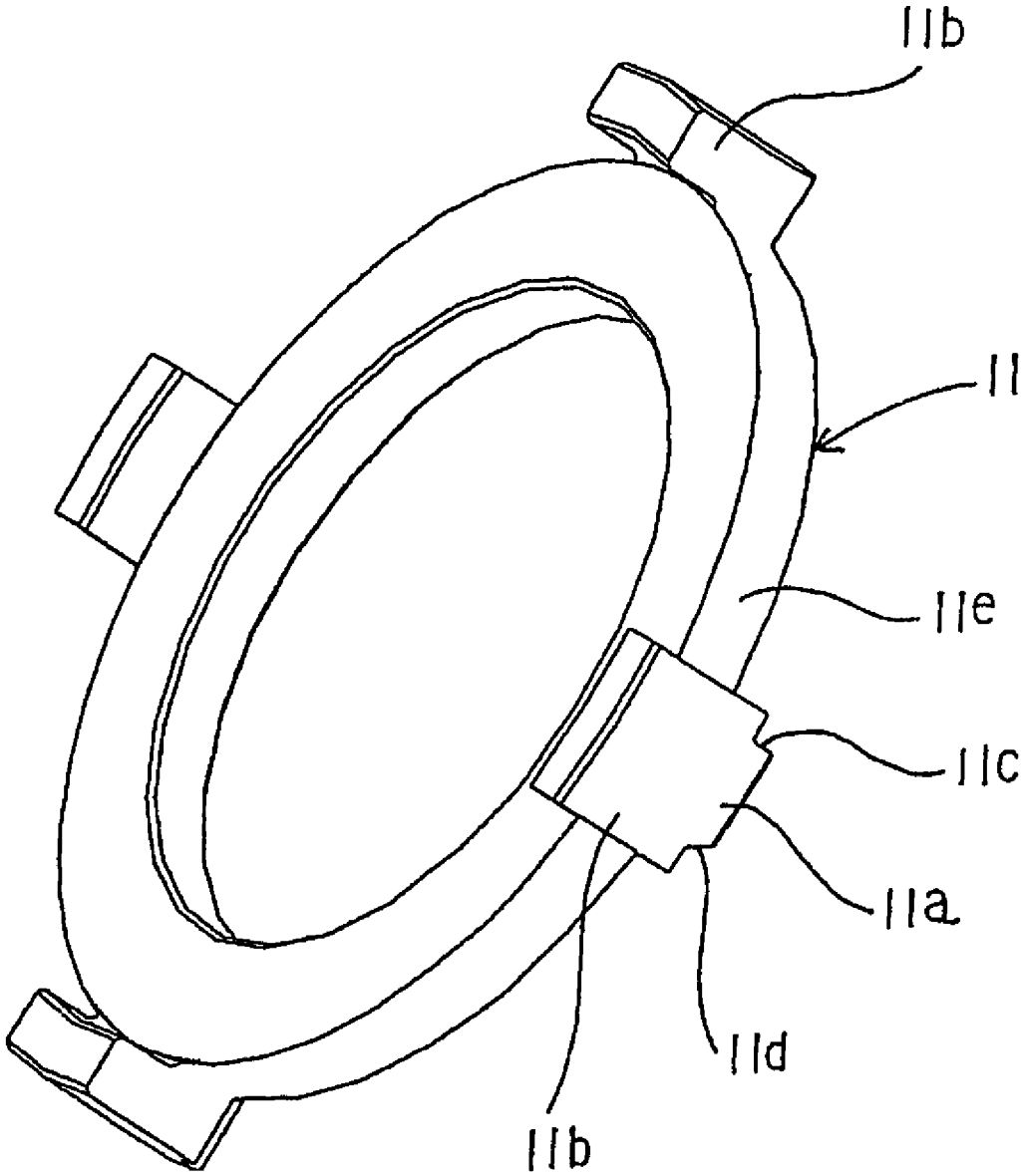
FIG. 11 is a perspective view of FIG. 9.
Figure 12:
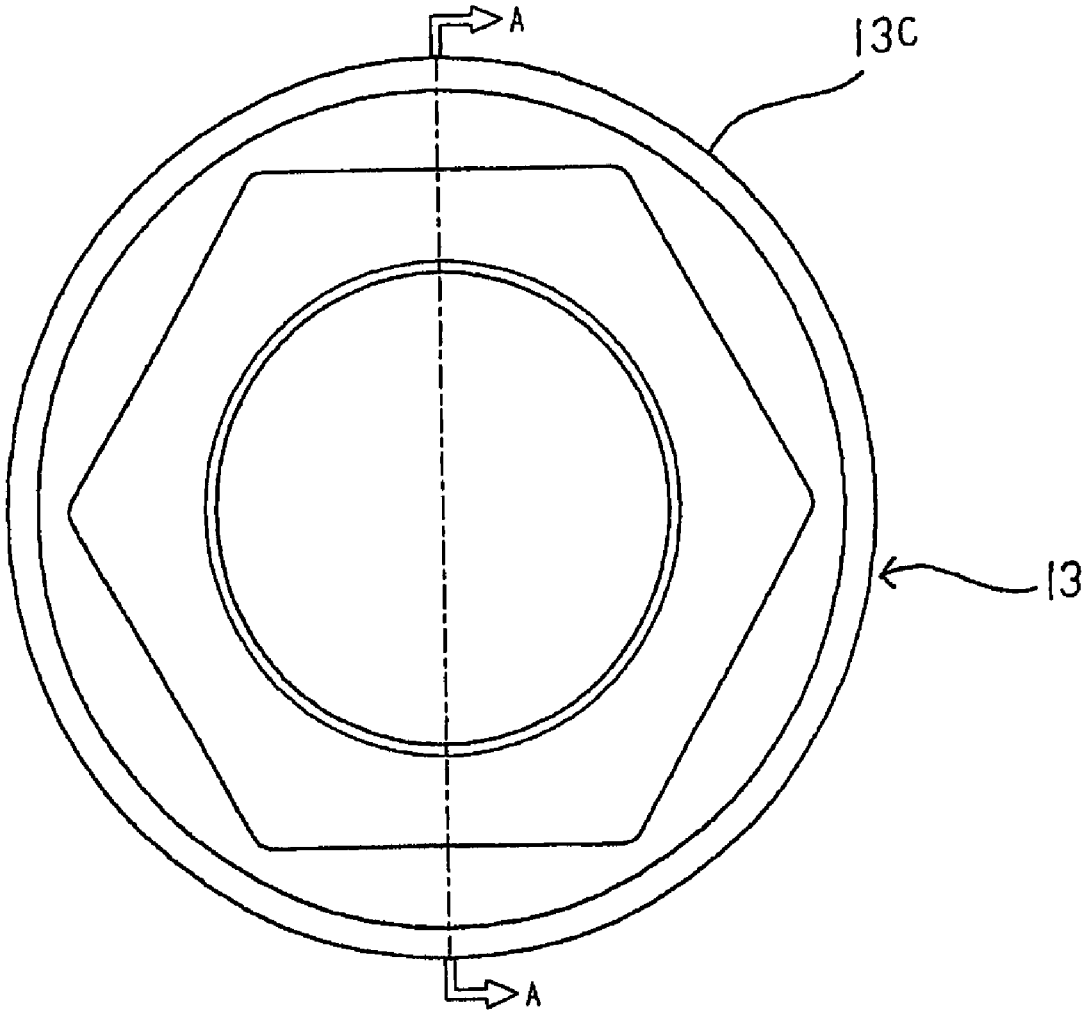
FIG. 12 is a front view of a spring holder of FIG. 2.
Figure 13:
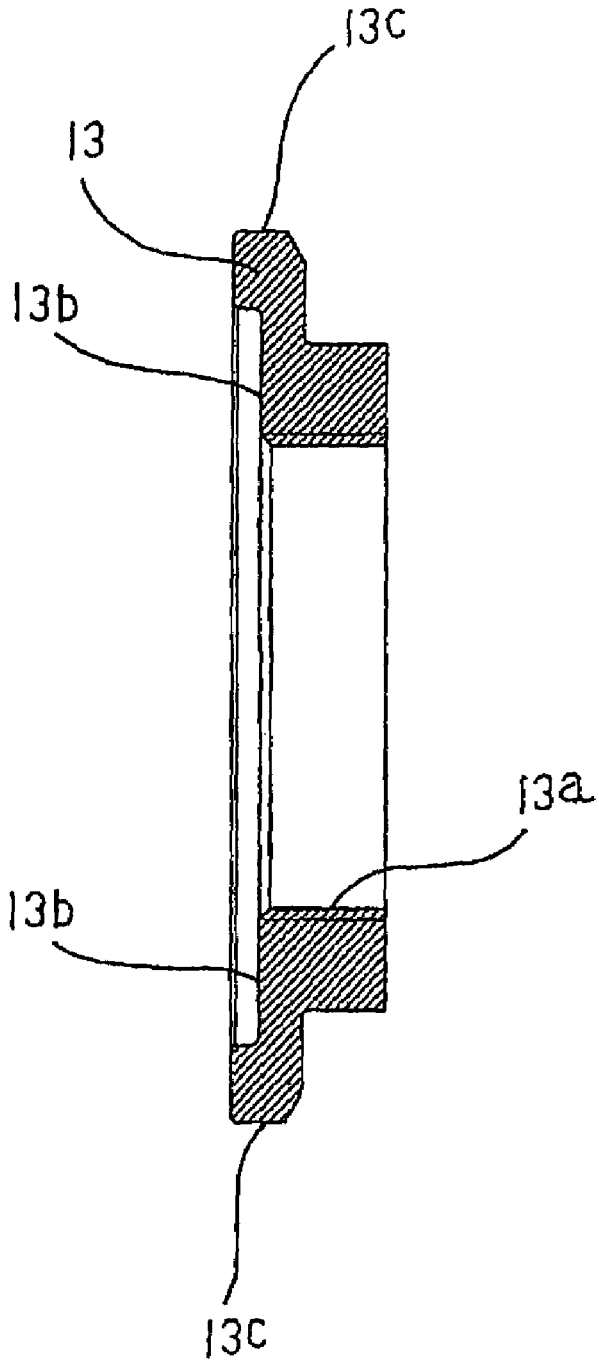
FIG. 13 is a sectional view taken along a line A-A of FIG. 12.

A hoist of an embodiment of the invention will be explained in reference to FIG. 1 through FIG. 13. FIG. 1 is a front view of a hoist of an embodiment of the invention, FIG. 2 is a view enlarging an essential portion of an overload preventing apparatus of FIG. 1, FIG. 3 is a disassembled perspective view of FIG. 2, FIG. 4 is a front view of a hand wheel of FIG. 2, FIG. 5 is a sectional view taken along a line A-A of FIG. 4, FIG. 6 is a front view of a drive member of FIG. 2, FIG. 7 is a plane view of FIG. 6, FIG. 8 is a sectional view taken along a line A-A of FIG. 7, FIG. 9 is a front view of a rotation drive member of FIG. 2, FIG. 10 is a bottom view of FIG. 9, FIG. 11 is a perspective view of FIG. 9, FIG. 12 is a front view of a spring holder of FIG. 2, FIG. 13 is a sectional view taken along a line A-A of FIG. 12.

In the drawings, numeral 1 designates the load sheave, numeral 2 designates the drive shaft axially supported rotatably by the load sheave 1, notation 2*a* designates the fitting portion with a pressure receiving member 4, notation 3*a* designates the speed reducing gear brought in mesh with a gear provided at a front end of the drive shaft 2 for reducing a speed of rotation, notation 3*b* designates the load gear brought in mesh with a small gear (not illustrated) integral with the speed reducing gear 3*a* for rotating the load sheave 1, numeral 4 designates the pressure receiving member, notation 4*a* designates the boss portion of the pressure receiving member, notation 5 designates reverse rotation preventing ring, numeral 6 designates the claw for controlling to pivot the reverse rotation preventing ring 5 in one direction, numeral 7 designates the spring for urging the claw 6, numeral 8 designates the brake plate, numeral 9 designates the hand wheel constituting operating means, including the fitting recess portion 9*a* to which the laterally prolonged shape projection 11*b* of the rotation drive member 11 is fitted, the inner side end face 9*d* with which end faces of the drive member 10 and the spring holder 13 are brought into contact, and the ring-like guide portion 9*e* brought into sliding contact with the guide portion 10*g* of the drive member 10 and the guide portion 13*c* of the spring holder 13 at the inner side inner periphery 9*c* of the hand wheel 9, numeral 10 designates the drive member, and notation 10*a* designates the female screw portion of the drive member screwed with the pressure receiving member 4. Notation 10*b* designates the flange portion of the drive member 10 having an outer diameter larger than an inner diameter of the hand wheel 9, and an end face thereof is constituted by a shape of a circular disk. Notation 10*c* designates the boss portion to which the rotation drive member 11 and the spring 12 are inserted to be fitted, notation 10*d* designates the engaging teeth formed at a circular disk face of the flange portion 10*b* on a side of the hand wheel and a shape thereof is constituted by a shape with which the overload preventing engaging teeth 11*a* of the rotation drive member 11 mentioned later is brought into close contact. The engaging teeth 10*d* includes the locking teeth portion 10*j* having a steep inclined face substantially in an orthogonal direction and the inclined teeth portion 10*k* having an inclined face. Notation 10*e* designates the screw groove screwed with the spring holder 13 mentioned later, notation 10*f* designates the positioning locking step portion with which the spring holder is brought into contact, notation 10*g* designates the guide portion brought into sliding contact with the guide portion 9*e* of the hand wheel 9 at an outer peripheral face of the flange 10*b* for supporting the hand wheel, notation 10*h* designates the opening portion in a fan-like shape, notation 10*i* designates the end portion. The opening portion 10*h* is inserted with the rotation restricting member 14 fixedly attached to an end portion of the drive shaft 2, when the drive member 10 is rotated in a direction of loosening the screw by the female screw 10*a*, the end portion 10*i* of the opening portion 10*h* of the drive member 10 is brought into contact with the rotation restricting member 14 to restrict rotation, thereby, the drive member 10 is prevented from being loosened excessively.

Further, normally, a predetermined interval is provided between the end portion 10*i* of the opening portion 10*h* of the drive member 10 and the rotation restricting member 14 in a rotational direction. Numeral 11 designates the rotation drive member fitted to the boss portion 10*c* of the drive member 10, including the ring-like link portion 11*e*, and the fitting projected portion 11*b* constituting a laterally prolonged shape projection extended in an axial direction of the drive member 10 to be fitted with the fitting recess portion 9*a* of the hand wheel 9 in a width direction at an outer periphery of the ring-like link portion 11*e* and a side of the drive member 10 of the laterally prolonged shape projection 11*b* is provided with overload preventing locking teeth 11*a* projected from an end face of the rotation drive member 11 on the side of the drive member 10 to the side of the drive member 10 and brought in mesh with the engaging teeth 10*d* of the drive member 10. The overload preventing locking teeth 11*a* includes the locking teeth portion 11*c* having a steep inclined face substantially in an orthogonal direction and the inclined teeth portion 11*d* having an inclined face.

According to the embodiment, the rotation drive member 11 is movable in the axial direction of the drive member 10 along the fitting recess portion 9*a* of the hand wheel 9 against an urge force of the spring 12 mentioned later. As shown by FIG. 9, a length h in an axial direction of the projection 11*b* is formed to be long relative to a thickness of the ring portion 11*e* to ensure a sufficient engaging length for engaging the rotation drive member 11 to the hand wheel 9 to be able to transmit a movement thereof. Further, 4 pieces of the projections 11*b* are provided at an outer periphery of the ring-like link portion 11*e* of the rotation drive member 11 and 4 pieces of the engaging recess portions 9*a* are provided at the hand wheel 9. The number of pieces is not limited to 4 pieces. Further, a gap is provided between the outer periphery of the projection 11*b* and the engaging recess portion 9*a* of the hand wheel 9 for reducing friction. Numeral 12 designates the spring for urging the rotation drive member 11 to the side of the drive member 10, the spring 12 comprises the inner spring 12*a*, the outer spring 12*b*, wound around the boss portion 10*c* of the drive member 10, and arranged at a space between the drive member 10 and the inner side inner periphery 9*c* of the hand wheel and between the rotation drive member 11 and the spring holder 13. Numeral 13 designates the spring holder, including the screw portion 13*a* screwed with the screw groove 10*e* of the drive member 10, the contact face 13*b* brought into contact with the locking step portion 10*f* of the drive member 10, and the guide portion 13*c* having an outer diameter larger than the inner diameter of the hand wheel 9 and brought into sliding contact with the ring-like guide portion 9*e* of the hand wheel 9 at an outer periphery thereof. Numeral 14 designates the rotation restricting member fixedly attached to the end portion of the drive shaft 2 and fitted to the opening portion of the drive member 10. The hoist is driven and braked by a so-to-speak mechanical brake constituted by the drive member 10, the pressure receiving member 4, the reverse rotation preventing ring 5, the brake plate 8 connected to the hand wheel 9 by way of the rotation drive member 11.

As described above, the hand wheel 9 is provided with the space 9*f* having a length substantially the same as a width of the inner periphery 9*c* of the hand wheel 1 between the inner peripheral face 9*c* and the outer periphery of the drive member 10, and the space 9*f* is inwardly provided with the rotation drive member 11 engaged with the drive member 10 and the hand wheel 9 for transmitting driving of the hand wheel 9 to the drive member 10, the spring member 12 wound around the boss portion 10*c* of the drive member 10 for pressing the rotation drive member 11 to the side of the drive member 10, and the spring holder 13 screwed to the screw groove 10*e* of the drive member 10 for pressing the spring member 12.

Further, the drive member 10 is provided with the step portion 10*f* for restricting the spring holder 13 from moving to the side of the rotation drive member 11, the spring holder 13 is screwed to the screw groove 10*e* of the drive member, brought into contact with the step portion 10*f* to be fixed, under the state, the guide portion 13*c* of the outer periphery of the spring holder 13 is brought into sliding contact with the ring-like guide 9*e* of the hand wheel 9 and is constituted to guide rotation of the hand wheel 9, further, the guide portion 10*g* of the drive member 10 is brought into sliding contact with the ring-like guide 9*e* of the hand wheel 9 on the side of the drive member 10 and is constituted to guide rotation of the hand wheel 9. In this way, the ring-like guides 9*e* of the hand wheel 9 are brought into sliding contact with the guide portion 13*c* of the spring holder 13 and the guide portion 10*g* of the drive member 10 and are supported by the guide portions.

Further, the spring member 12 wound around the drive member 10 comprises the small diameter coil spring 12*a* and the large diameter coil spring 12*b* and provided to expand at inside of a cylindrical space extended straight in the axial direction between the rotation drive member 11 and the spring holder 13 between the drive member 10 and the inner periphery 9*c* of the hand wheel 9. The inner side of the drive member 10 is screwed with the female screw 10*a*, and the female screw 10*a* is screwed with the screw provided at the outer periphery of the pressure receiving member 4. The outer periphery of the pressure receiving member 4 is coaxially and rotatably provided with the brake plate 8, and a pair of the brake plates 8 are provided between a pressure receiving portion formed at one end of the pressure receiving member 4 and the drive member 10 and rotatably to the pressure receiving member 4. Further, the reverse rotation preventing ring 5 is provided between the brake plates 8, 8 coaxially at the outer periphery of the pressure receiving member 4.

Further, numeral 18 designates the frame main body of the hoist and is molded by diecast molding or lost wax casting using an aluminum alloy.

As shown by FIG. 1, the frame main body 18 includes a drive side frame 18*a*, a speed reducing side frame 18*b* and a connecting frame 18*c* connecting the frames, the frames 18*a*, 18*b* are respectively expanded to the drive side, the speed reducing side, and end edge portions of outer peripheries thereof are attached with the drive side cover 20*a* and the speed reducing machine side cover 20*b* in a close contact state. The drive side expanded portion of the drive side frame 18*a* is formed with an opening portion 19*a* directed to the drive side, inside of the opening portion 19*a* contains the pressure receiving member 4, the brake plate 8, the reverse rotation preventing ring 5, the claw 6, the spring 7. A side end portion of the drive side frame 18*a* is provided with the ring-like groove 19*b* fitted with the hand wheel 9, the ring-like groove 19*b* is previously provided with the space 19*c* in the axial direction sufficient for fitting the hand wheel to the ring-like groove 19*b* even when the hand wheel 9 is moved in the axial direction by the mechanical brake.

By the constitution, the pressure receiving member 4, the brake plate 8, the reverse rotation preventing ring 5, the claw 6, the spring 7 contained in the opening portion 19*a* is hermetically closed from outside by mounting the hand wheel 9 to the ring-like groove 19*b* provided at the side end portion of the drive side frame 18*a*, and therefore, invasion of dust from outside can be prevented, and a reduction in a performance of the mechanical brake or the overload preventing apparatus by dust can be prevented.

Further, notations 18*d*, 18*e* designate bearing plates fixed to the inner side of the connecting frame 18*c* for bearing the load sheave 1 rotatably, wear resistance of the bearing portion of the load sheave 1 can be promoted, and by being made by an aluminum alloy by diecast molding, the load sheave 1 can be light-weighted without reducing wear resistance performance.

Next, an explanation will be given of an operation of switching the drive force according to the embodiment. In a normal operation, rotation of the hand wheel 9 is transmitted to the drive shaft 2 by way of the rotation drive member 11, the drive member 10, the pressure receiving member 4, a speed of the drive shaft 2 is reduced by the speed reducing gear 3*a*, the load gear 3*b* to drive the load sheave 1 at a reduced speed.

Next, an explanation will be given of constitution and operation of the overload preventing apparatus operated in overloading. The hand wheel 9 is inwardly provided with the coil spring 12, the rotation drive member 11, the drive member 10, and the spring 12 urges the rotation drive member 11 in the axial direction, that is, on the side of the drive member 10. Further, the rotation drive member 11 is connected to the hand wheel 9 integrally rotatably and slidably in the axial direction by fitting the fitting projected portion 11*b* to the fitting recess portion 9*a* of the hand wheel 9. The drive member 10 is made to be able to be rotated by following rotation of the rotation drive member 11 in normal rotation by bringing the engaging teeth 10*d* of the drive member 10 in mesh with the overload preventing engaging teeth 11*a* of the rotation drive member 11. That is, when the rotation drive member 11 is rotated by operating the hand wheel 9, the drive member 10 is rotated by way of the overload preventing engaging teeth 11*a* of the rotation drive member 11 and the engaging teeth 10*d* of the drive member 10, the drive member 10 presses the pressure receiving member 4 to rotate, the drive shaft 2 is rotated by rotating the pressure receiving member 4, the load sheave 1 is rotated from the drive shaft 2 by way of the speed reducing gear 3*a*, the load gear 3*b* to hoist up a load.

In an operation of hoisting up the load, when the hand wheel 9, the rotation drive member 11 are rotated in a state of applying a torque equal to or larger than a predetermined value to the hand wheel by hanging up the load in an overload state, the inclined teeth portion 11*d* of the rotation drive member 11 brought in mesh with the engaging teeth 10*d* of the drive member 10 is pressed back in the axial direction by being slid on an engaging face of the inclined teeth portion 10*k* of the engaging teeth 10*d* against the urge force of the spring 12, the overload preventing engaging teeth 11*a* of the rotation drive member 11 ride over the engaging teeth 10*d* of the drive member 10, and is brought in mesh with the next engaging teeth 10*d* of the drive member 10 by the urge force of the spring 12, in the overload state, the riding over operation of the engaging teeth 10*d* of the drive member 10 by the overload preventing engaging teeth 11*a* of the rotation drive member 11 is continuously carried out, and therefore, transmission of the torque from the rotation drive member 11 to the drive member 10 is restricted, and a drive force is not transmitted to the drive member 10.

In this way, in the overload state, when the hand wheel 9 is rotated in the hoist up direction, although the rotation drive member 11 is rotated, the overload preventing engaging teeth 11*a* of the rotation drive member 11 are slid to ride over the engaging teeth 10*d* of the drive member 10 to be rotated idly, and therefore, rotation of the rotation drive member 11 is not transmitted to the drive member 10, and the hoist up operation in overloading is prevented. In idly rotating the drive member 11, the spring holder 13 is screwed to the screw groove 10*e* of the drive member 10 in a direction the same as the idly rotating direction, and therefore, loosening of the spring holder 13 by the idly rotating operation is not brought about.

According to the invention, the space having the length substantially the same as the width of the hand wheel 9 is provided between the inner peripheral face 9*c* of the hand wheel 9 and the outer periphery of the drive member 10, the springs 12*a*, 12*b* are wound by utilizing the space, and therefore, the coil spring 12 can be provided with a large stroke of an amount of the thickness of the hand wheel 9, and the rotation drive member 10 can be urged by utilizing the coil spring 12 having the large stroke without making the apparatus large-sized. Further, also the height of the overload preventing engaging teeth 11*a* of the rotation drive member 11 can be enlarged in accordance with the size of the stroke, and therefore, a rate of an error of a fabrication tolerance for the height of the overload preventing engaging teeth 11*a* can be reduced, a variation in a slip load can be restrained from being brought about to thereby achieve an effect of dispensing with also an adjustment in delivery of the hoist.

Further, the rotation drive member 11 is urged by a uniform urge force by the coil spring 12 wound around the outer periphery of the drive member 10, and therefore, the rotation drive member 11 can be moved in the axial direction without being inclined in overloading and is not interfered with the inner peripheral face of the hand wheel 9, and therefore, the hand wheel 9 can smoothly be operated, further, overload of the hand wheel 9 can be detected in a stable state. Further, the hand wheel 9 is constituted not to be influenced by the urge force of the coil spring 12, and therefore, the friction resistance of the sliding face when idly rotated is small and stabilized, further, even when the hand chain 9 is skewedly pulled, the coil spring 12 and the rotation drive member 11 are not influenced by the skewedly opening operation, and therefore, even in skewedly pulling the hand chain 9, overload can stably be detected. Furthermore, the ring-like guide portion 9*e* of the hand wheel 9 is guided by the guide portion 10*g* of the outer peripheral face of the flange 10*b* of the drive member 10 and the guide portion 13*c* of the spring holder 13, and therefore, even when the hand chain is inclinedly operated, the hand wheel 9 is not inclined, and therefore, the stable operation can be carried out.

Further, the spring holder mounting apparatus of the invention includes the fitting projected portion 11*b* inserted to be fitted to the fitting recess portion 9*a* of the hand wheel 9, the rotation drive member 11 having the overload preventing engaging teeth 11*a* provided at a front end of the engaging projected portion 11*b*, the drive member 10 having the locking step portion 10*f* for the spring holder brought in mesh with the overload preventing engaging teeth 11*a* and cooperatively moved with driving of the rotation drive member 11, the spring member 12 for urging the rotation drive member 11 to the side of the drive member 10, and the spring holder 13 screwed with the screw groove 10*e* provided at the end portion of the drive member 10, and is characterized in that the spring holder 13 is screwed to be fastened to the screw groove

10*e* of the drive member 11 when pivoted in a direction the same as the direction of idly rotating the rotation drive member 11 to thereby bring the end face of the spring holder 13 into contact with the locking step portion of the drive member 10. Therefore, according to the embodiment, a step of mounting and setting the drive member 10, the rotation drive member 11 and the spring member 12 to the hand wheel 9 can be carried out only by a step of screwing the spring holder 13 to the drive member 10, and therefore, a number of parts and a number of integrating steps can considerably be reduced in comparison with the background art apparatus. Further, by bringing the spring holder 13 into contact with the locking step portion 10*f* of the drive member 10, the spring is finished to be set to dispense with the adjustment. Further, the spring holder 13 is fastened to the drive member 10 in the direction the same as the direction of idly rotating the rotation drive member 11, and therefore, when the rotation drive member is idly rotated by overload, a force in a fastening direction is operated, and therefore, a variation in an operating load by loosening the spring holder 13 can be prevented. Further, according to the invention, a function of restricting the hand wheel from being moved in the axial direction to an outer side and a function of holding the spring and a function of preventing means for holding the spring (nut) from being loosened can all be resolved by using only the spring holder, it is not necessary to provide the rotation restricting member 35 provided at the overload preventing apparatus of the hoist in the background art of FIGS. 14, 15, further, also working related thereto is dispensed with, a number of parts can be reduced to achieve an effect of reducing cost.

INDUSTRIAL APPLICABILITY

The overload preventing apparatus of the invention is particularly preferable for a small-sized hoist since there can be provided the overload preventing apparatus which uses the spring member having the large stroke without making the apparatus large-sized and in which the rotation drive member is operated without receiving a variation in the urge force by the spring member in overloading.

According to the overload preventing apparatus of the background art, the belleville spring is used as the urging means, and therefore, the stroke in the axial direction is small, and therefore, also the height of the engaging teeth is small, however, according to the invention, the space having the length substantially the same as the width of the hand wheel is provided between the inner peripheral face of the hand wheel and the outer peripheral face of the drive member, the coil spring is wound around the outer periphery of the drive member by utilizing the space, the coil spring is provided with the large stroke of the amount of the thickness of hand wheel, and therefore, the rotation drive member can be urged by using an elastic member having the large stroke without making the apparatus large-sized, further, also the height of the engaging teeth of the rotation drive member can be enlarged in accordance with the size of the stroke, and therefore, the rate of the error of the fabrication tolerance of the height of the engaging teeth can be reduced, further, since the stroke is large, the rate of the error of the spring pressure by the accumulated dimension error of the related parts can be reduced, thereby, the variation in the slip load can be restrained from being brought about, also the adjustment in delivery of the hoist is dispensed with, the adjustment cost is totally dispensed with to achieve an effect of reducing cost.

Further, the rotation drive member is urged by the uniform urge force by the coil spring wound around the outer periphery of the drive member, and therefore, the rotation drive member can be moved in the axial direction without being inclined in overloading and does not interfere with the inner peripheral face of the hand wheel, and therefore, the hand wheel can smoothly be operated, further, overload of the hand wheel can be detected at a stable state. Further, the hand wheel is constituted not to be influenced by the urge force by the spring member, and therefore, the friction resistance of the sliding face when idly rotated is small and stabilized, further, even when the hand chain is skewedly pulled, the spring member and the rotation drive member are not influenced by the skewedly pulling operation, and therefore, even when the hand chain is pulled skewedly, overload can stably be detected. Furthermore, the hand wheel is guided by the guide face of the flange member and the guide face of the spring holder of the drive member, and therefore, even when the hand chain is inclinedly operated, the hand wheel is not inclined, and therefore, the stable operation can be carried out. Further, by using the double springs as the coil spring, the large urge force can be exerted by the short length, and therefore, the length in the axial direction of the spring can be shorted to achieve an effect of capable of downsizing the hoist.

Figure 14:
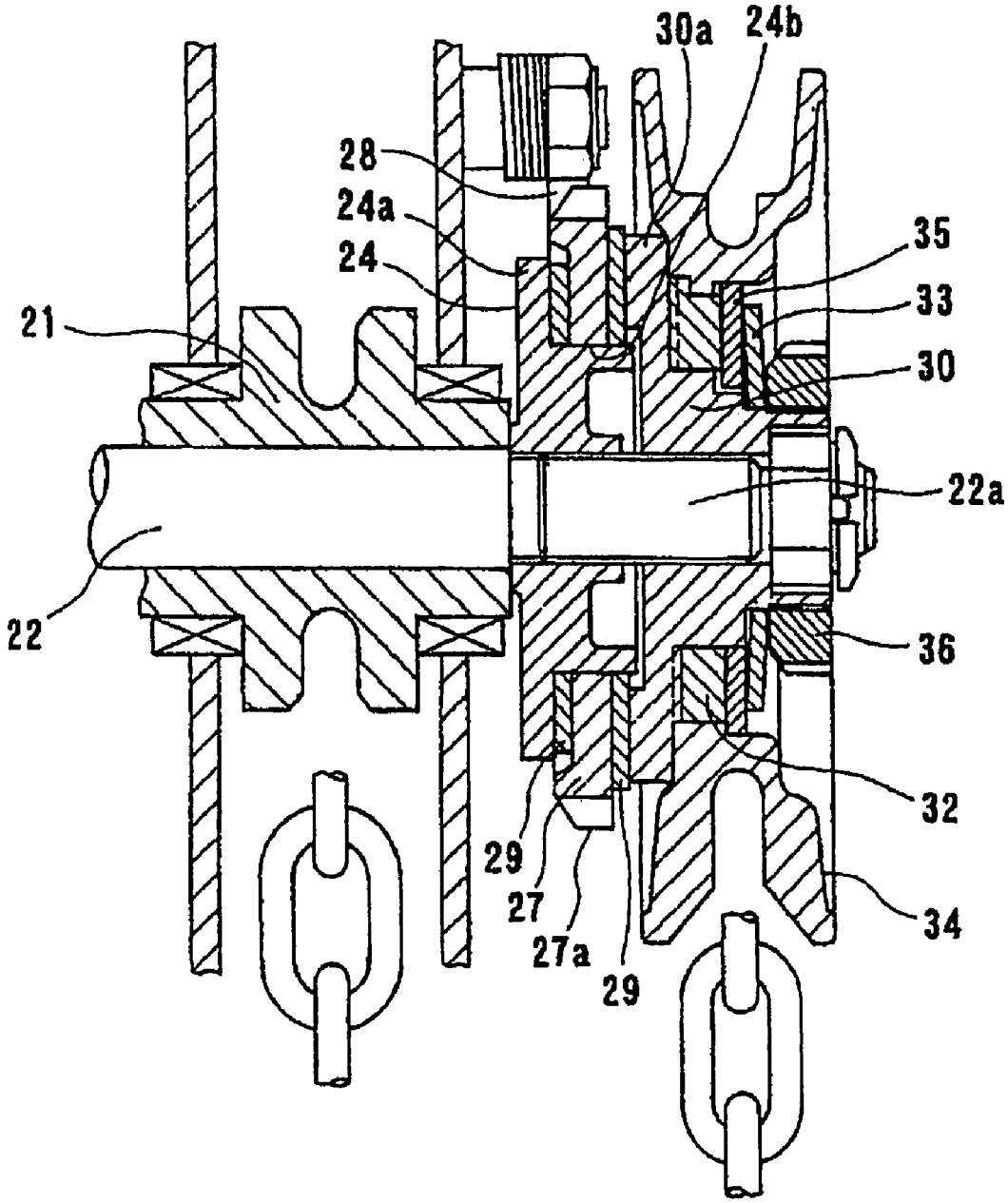
FIG. 14 is a front view of a hoist of a background art.
Figure 15:
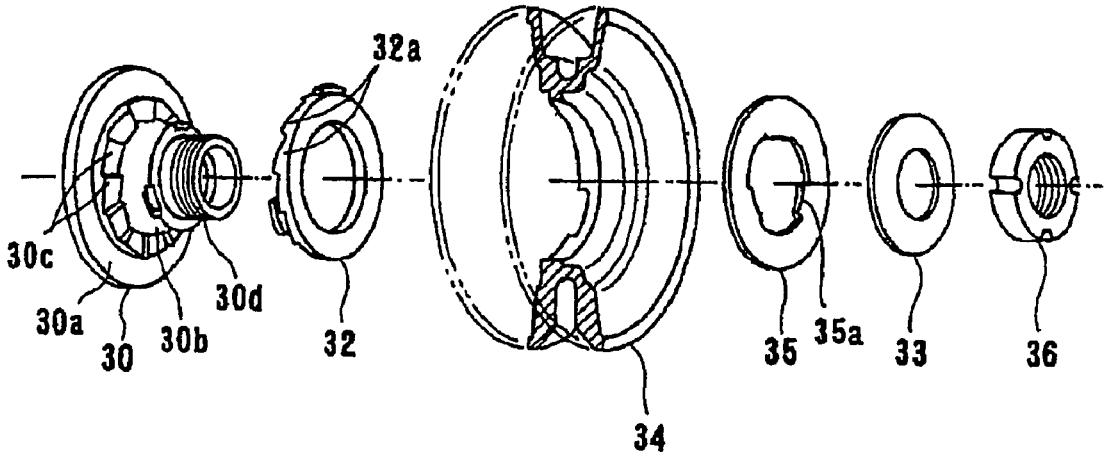
FIG. 15 is a disassembled perspective view showing an essential portion of an over load preventing apparatus of FIG. 14.

According to the invention, the step of mounting and setting the drive member, the rotation drive member and the spring member to the operating means can be carried out only by the step of screwing the spring holder to the drive member to be brought into contact with the spring holder locking step portion, and therefore, the number of parts and the number of integrating steps can considerably be reduced in comparison with the background art apparatus. Further, the spring holder is screwed to fasten to the drive member when pivoted in the direction the same as the direction of idly rotating the rotation drive member, and therefore, a force in the fastening direction is operated when the rotation drive member is idly rotated by overload, and therefore, the variation in the operating load by loosening the spring holder can be prevented. Further, according to the invention, the function of restricting the hand wheel from being moved in the axial direction on the outer side, the function of holding the spring, and the function of preventing the means for holding the spring (nut) from being loosened can all be resolved by using only the drive member and the spring holder, it is not necessary to provide the rotation restricting member 35 provided to the overload preventing apparatus of the hoist of the background art as shown by FIG. 14, FIG. 15, further, also working related thereto is dispensed with, the number of parts can be reduced to achieve an effect of reducing cost. Further, rotation of the operating means is guided by the guide portion of the spring holder, and therefore, an inclination is not brought about even by a pulling force in a skewed direction of the hand chain to achieve an effect of capable of stabilizing the operation of the hand chain and the operating load.

The invention claimed is:

1. An overload preventing apparatus of a hoist, the overload preventing apparatus comprising:

operating means for operating the hoist, the operating means having an inner peripheral face;

a drive member for driving cooperatively with driving of the operating means, the drive member having an outer periphery;

a drive apparatus for transmitting a driving force of the drive member to a drive shaft for driving the hoist by way of brake means;

a rotation drive member located in an interval between the inner peripheral face of the operating means and the outer periphery of the drive member in sliding contact with a ring-like guide portion provided at an end face of the inner peripheral face of the operating means, the rotation drive member being engaged with the drive member and the operating means and having means for transmitting a driving force of the operating means to the drive member and restricting torque transmitted to the drive member by torque of the operating means;

a spring holder; and a spring member wound around the outer periphery of the drive member in a cylindrical space formed between a back face of the rotation drive member and the spring holder, the spring member extending in an axial direction for pressing the rotation drive member to a side of the drive member, wherein the spring holder is fixed by a locking step portion of the drive member to restrict the spring holder from moving to a side of the rotation drive member by pressing against an end portion of the spring member, and the spring holder has a guide portion in sliding contact with the ring-like guide portion provided at the end face of the inner peripheral face of the operating means.

2. The overload preventing apparatus according to claim 1, characterized in that wherein the operating means is a hand wheel having the ring-like guide portion at the end face of the inner peripheral face, and an outer periphery of a flange of the drive member and an outer periphery of the spring holder are in sliding contact with the ring-like guide portion to support the hand wheel.

3. The overload preventing apparatus according to claim 2, wherein the spring holder is in contact with the locking step portion of the drive member and screw fastened to the drive member by rotation in a direction that is the same as a direction of idle rotation the rotation drive member.

4. The overload preventing apparatus according to claim 2, wherein the operating means is positioned in a predetermined gap between the drive member and the spring holder.

5. The overload preventing apparatus according to claim 1, wherein the drive member has engaging teeth, the rotation drive member includes a ring-like link and a plurality of laterally prolonged shape projections projecting in an axial direction of the drive member from an outer periphery of the ring-like link and fitting to the inner peripheral face of the operating means in a width direction, and end portions of the laterally prolonged shape projections on a side of the drive member are provided with overload preventing engaging teeth that mesh with the engaging teeth of the drive member.

6. The overload preventing apparatus according to claim 5, wherein the overload preventing engaging teeth project from an end face of the ring-like link at the end portions of the projections on the side of the drive member.

7. The overload preventing apparatus according to claim 6, wherein the ring-like link is thinner than a length of one of the laterally prolonged shape projections.

8. The overload preventing apparatus according to claim 5, wherein the ring-like link is thinner than a length of one of the laterally prolonged shape projections.

9. The overload preventing apparatus according to claim 1, wherein the spring member is a coil spring wound around the outer periphery of the drive member and expanded between the rotation drive member and the spring holder.

10. The overload preventing apparatus according to claim 9, wherein the coil spring comprises a large diameter coil spring and a small diameter coil spring laminated on an inner side of the large diameter coil spring.

11. The overload preventing apparatus according to claim 10, wherein the spring holder is in contact with the locking step portion of the drive member and screw fastened to the drive member by rotation in a direction that is the same as a direction of idle rotation the rotation drive member.

12. The overload preventing apparatus according to claim 9, wherein the spring holder is in contact with the locking step portion of the drive member and screw fastened to the drive member by rotation in a direction that is the same as a direction of idle rotation the rotation drive member.

13. The overload preventing apparatus according to claim 1, wherein the spring holder is in contact with the locking step portion of the drive member and screw fastened to the drive member by rotation in a direction that is the same as a direction of idle rotation of the rotation drive member.

14. The overload preventing apparatus according to claim 1, wherein the operating means is a hand wheel, and the spring holder has an outer diameter that is larger than an inner diameter of the hand wheel for guiding the hand wheel by being in sliding contact with the ring-like guide portion provided at the end face of the inner peripheral face of the hand wheel.

15. The overload preventing apparatus according to claim 1, wherein the operating means is positioned in a predetermined gap between the drive member and the spring holder.

* * * * *